United States Patent [19]

Hollis

[11] Patent Number: 4,593,541

[45] Date of Patent: Jun. 10, 1986

[54] LOCKING ELECTRICAL OUTLET BOX

[76] Inventor: Nathaniel Hollis, 239 Highland, Highland Park, Mich. 48203

[21] Appl. No.: 607,771

[22] Filed: May 7, 1984

[51] Int. Cl.[4] ..... E05B 65/00

[52] U.S. Cl. ..... 70/57; 70/161

[58] Field of Search ..... 70/57, 58, 63, 158–162, 70/14; 339/37

[56] References Cited

U.S. PATENT DOCUMENTS

| | | | |
|---|---|---|---|
| 2,643,787 | 6/1953 | Rockman | 70/57 |
| 2,987,909 | 6/1961 | Shlank | 70/57 |
| 3,131,985 | 5/1964 | Blonder | 70/57 |

*Primary Examiner*—Robert L. Wolfe

*Attorney, Agent, or Firm*—Cullen, Sloman, Cantor, Grauer, Scott & Rutherford

[57] ABSTRACT

A locking electrical outlet box is positioned over one or a pair of electrical wall outlets having a conventional apertured face plate secured to the wall. The box includes an apertured bottom wall for registry with the wall outlets with the face plate removed and for fastening the box upon the wall and the face plate applied to the bottom all. The box includes a cover hinged thereon with an apertured latch bar and one or a pair of outwardly opening slots adapted to receive an electric cord from an appliance terminating in a plug. A key lock is anchored upon the box and includes a rotatable latch registerable with the latch bar.

3 Claims, 6 Drawing Figures

FIG. 1
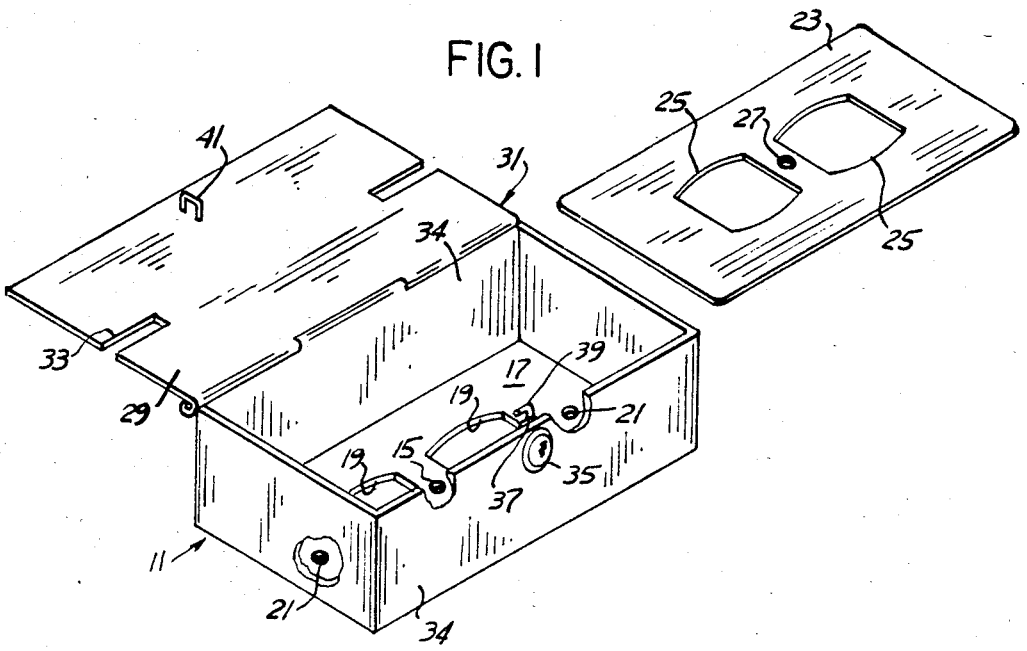
FIG. 2
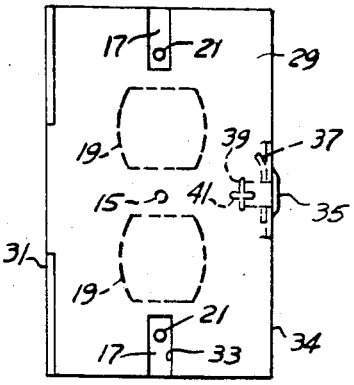
FIG. 3
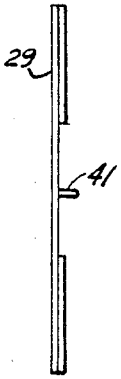
FIG. 5
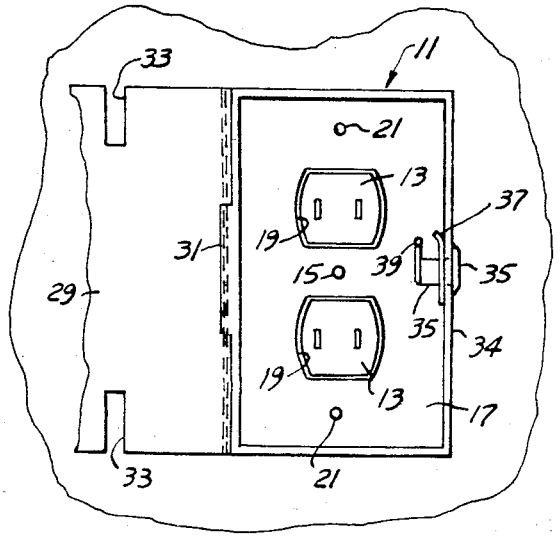
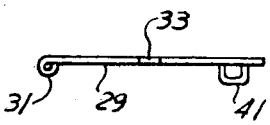
FIG. 4
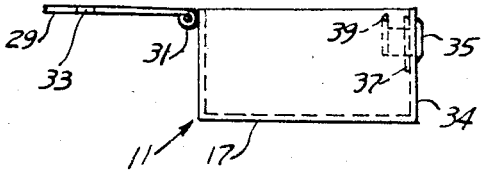
FIG. 6

LOCKING ELECTRICAL OUTLET BOX

BACKGROUND OF THE INVENTION

1. Field of Invention

The present invention relates to an electrical outlet box adapted for positioning over a pair of electrical wall outlets and secured to the wall and having a slotted lockable cover on the box adapted to receive an electrical cord terminating in a plug for registry within an outlet.

2. Description of the Prior Art

The present invention is provided because of the high rate of home and business thefts. In most thefts, articles of an electrical nature are the most sought after such as televisions and radios, etc. At the present time, removal of such articles by a thief is a simple matter of unplugging the item and taking it.

SUMMARY OF THE INVENTION

An important feature of the present invention is to provide a locking electrical outlet box to prevent removal of the electrical plug to reduce such losses. The electrical locking outlet box has the further feature of protecting children and preventing unauthorized persons from access to the electrical wall outlet.

A further feature is to provide a metal box of sufficient thickness so as to provide an enclosure strong enough to support a key lock and clip together with a hinged cover for opening and closing the box and including a latch bar registerable with the latch upon the key lock.

Another feature includes easy installation of the box over a pair of electrical outlets by the use of existing screws and the existing face plate with standard hole patterns.

Another feature is to provide upon the hinged cover for the box of aligned outwardly opening slots which are adapted to receive an electrical cord which terminates in an electrical prong plug enclosed within the box and adapted for registry within an electrical wall outlet.

These and other features and objects will be seen from the following specification and claims in conjunction with the appended drawing.

THE DRAWING

FIG. 1 is a front perspective view of the opened locking electrical outlet box partly broken away and a conventional face plate.

FIG. 2 is a plan view of the outlet box and cover.

FIG. 3 is a right side view of the cover in FIG. 2.

FIG. 4 is an end view of the cover.

FIG. 5 is a plan view of the box with the cover open and fragmentarily shown.

FIG. 6 is an end view thereof.

It will be understood that the above drawing illustrates merely a preferred embodiment of the invention, and that other embodiments are contemplated within the scope of the claims hereafter set forth.

DESCRIPTION OF A PREFERRED EMBDODIMENT OF THE INVENTION

Referring to the drawing, the present locking electrical outlet box made of metal, generally designated at 11, FIG. 1 is adapted for positioning over a pair of electrical wall outlets 13 having a conventional face plate 23.

Fastener aperture 15 extends through bottom wall 17 of the box which includes a pair of electrical outlet clearance apertures 19 in registry with electrical outlets 13. Said bottom wall includes a pair of box mount apertures 21 adapted to receive conventional fasteners for securing the box to the wall or to connector portions of the conventional electrical outlets 13.

The conventional or standard face plate 23, FIG. 1, includes outlet apertures 25 and a central fastener aperture 27 adapted to receive the existing fastener by which the face plate is normally mounted upon the wall so as to overlie a pair of electrical outlets in a conventional manner.

The present locking electrical outlet box 11 includes a cover 29 hinged at 31 along one edge to one of the side walls 34 of said box and includes a pair of laterally spaced aligned outwardly opening electrical cord slots 33.

Key lock 35 of a conventional construction normally including a rotatable cylinder is projected through one of the side walls 34 and anchored in position by the lock clip 37, FIG. 2. Key lock 35 normally has a rotatable cylinder which terminates in the transverse latch 39 normally positioned within said box and adapted for retaining registry with a corresponding depending apertured latch bar 41 upon the interior of box cover 29.

In the illustrative embodiment, the dimensions of the locking electrical outlet box for the standard two plug electrical outlet are approximately $1\frac{1}{2}$ inches in depth, $4\frac{1}{2}$ inches in length and $2\frac{3}{4}$ inches wide. It is contemplated that the sides of the box can be enlarged for other multiple outlets.

The present locking electrical outlet box is constructed for easy installation by utilizing existing screws, the existing face plate and standard hole patterns. The three apertures 15 and 21 in bottom wall 17 of said box provide clearance for existing screws by which the box bottom 17 is mounted over a pair of spaced electrical wall outlets 13, FIG. 1. Corresponding apertures 19 in said bottom wall are adapted for clearance registry with said electrical outlets.

The pair of slots 33 in cover 29 provide for assembly and clearance of one or a pair of wires or cords therethrough, FIG. 1, before the cover is moved to a closed position and wherein the respective cords terminate in conventional prong plugs for registry within the corresponding one or a pair of wall outlets 13. The cords, not shown, extend for any electrical appliance, such as a TV, radio, etc.

After such registry, with the cover 29 closed, key operated lock 35 is adjusted so that the corresponding latch 39 moves into interlocking retaining registry with the corresponding apertured latch bar 41 depending from cover 29.

As an alternate use of the present locking electrical outlet box, the corresponding electrical prong plug or plugs of a pair of wires may be lockingly retained within the box 11 and not necessarily projected within the corresponding electrical outlets 13. This provides a means for preventing unauthorized use of the electrical appliance or other unauthorized usage of electrical outlets.

I claim:

1. A locking electrical outlet box positionable over a pair of electrical wall outlets having an apertured face plate secured to a wall;

said box including side walls and a bottom wall having a pair of outlet clearance apertures and fastener apertures for anchoring the box and face plate upon the wall, and the face plate upon said bottom wall;

and a cover along one edge hinged to a side wall and having a pair of spaced aligned outwardly opening slots adapted to receive an electrical cord of an appliance terminating in a plug positioned within said box and registerable within a wall outlet;

a key lock nested and anchored upon a side wall including a rotatable latch positioned within said box;

and an apertured latch bar depending from said cover within said box for interlock with said latch.

2. A locking electrical outlet box positionable over a pair of electrical wall outlets;

said box including side walls and a bottom wall having a pair of outlet clearance apertures and fasteners aperture for anchoring the box upon the wall;

and a cover along one edge hinged to a side wall and having a pair of spaced aligned outwardly opening slots adapted to receive an electrical cord of an appliance terminating in a plug positioned within said box and registerable within a wall outlet;

a key lock mounted and anchored upon a side wall including a rotatable latch positioned within said box;

and an aperture latch bar depending from said cover within said box for interlock with said latch.

3. A locking and electrical outlet box positioned over an electrical wall outlet having an apertured face plate secured to a wall;

said box including side walls and a bottom wall having a wall outlet clearance aperture and fasteners aperture for anchoring the box and face plate upon the wall and the face plate over said bottom wall;

and a cover along one edge hinged to a side wall and having an outwardly opening slot adjacent one edge adapted to receive an electrical cord of an appliance terminating in a plug positioned within said box and registerable within said wall outlet;

a key lock nested and anchored upon a side wall and including a rotatable latch positioned within said box;

and an apertured latch bar depending from said cover within said box for interlocking with said latch.

* * * * *